US006009615A

United States Patent [19]

McKean et al.

[11] Patent Number: 6,009,615

[45] Date of Patent: *Jan. 4, 2000

[54] METHOD OF MANUFACTURING A BISTABLE MAGNETIC ACTUATOR

[75] Inventors: Brian McKean, Ruddington; Derek Kenworthy, Manchester, both of United Kingdom

[73] Assignee: Brian McKean Associates Limited, Nottingham, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/617,795

[22] PCT Filed: Sep. 12, 1994

[86] PCT No.: PCT/GB94/01975

§ 371 Date: Mar. 7, 1996

§ 102(e) Date: Mar. 7, 1996

[87] PCT Pub. No.: WO95/07542

PCT Pub. Date: Mar. 16, 1995

[30] Foreign Application Priority Data

Sep. 11, 1993 [GB] United Kingdom ..... 9318876

[51] Int. Cl.[7] ..... H01F 7/06

[52] U.S. Cl. ..... 29/602.1; 29/609; 335/229; 335/261; 335/264

[58] Field of Search ..... 335/229–234; 29/606–609

[56] References Cited

U.S. PATENT DOCUMENTS

| | | | |
|---|---|---|---|
| 2,769,103 | 10/1956 | Kristiansen | 335/230 |
| 3,377,519 | 4/1968 | Stong . | |
| 3,952,272 | 4/1976 | Howell, Jr. | 335/264 |
| 4,533,890 | 8/1985 | Patel | 335/234 |
| 4,635,016 | 1/1987 | Guery | 335/230 |

FOREIGN PATENT DOCUMENTS

| | | |
|---|---|---|
| 0 186 393 A2 | 7/1986 | European Pat. Off. . |
| 0 225 388 | 6/1987 | European Pat. Off. . |
| 0 321 664 A2 | 6/1989 | European Pat. Off. . |
| 0 354 803 | 2/1990 | European Pat. Off. . |
| 0 458 302 A2 | 11/1991 | European Pat. Off. . |
| 0 460 666 A1 | 12/1991 | European Pat. Off. . |
| 0 534 572 A2 | 3/1993 | European Pat. Off. . |
| 1363793 | 4/1964 | France . |
| 2532107 | 2/1984 | France . |
| 33 38 551 A1 | 5/1985 | Germany . |
| 35 20 879 C1 | 9/1986 | Germany . |
| 2112212 | 11/1982 | United Kingdom . |

OTHER PUBLICATIONS

Lequesne, IEEE, "Fast–Acting, Long Stroke Solenoids With two Springs," pp. 194–202, 1989.

*Primary Examiner*—Lincoln Donovan
*Assistant Examiner*—Raymond Barrera
*Attorney, Agent, or Firm*—Fish & Richardson P.C.

[57] ABSTRACT

A magnetic actuator (10) suitable for the operation of electric circuit breakers which uses a laminated yoke structure (12) to increase permanent magnet flux holding forces. The actuator comprises a magnetic yoke (12) which forms both low and high reluctance flux paths with at least one permanent magnet (30) and an armature (40) axially reciprocable in a first direction within the yoke (12). The actuator is configured to provide a first low reluctance flux path and a first high reluctance flux path when the armature (40) is in a first position and a second low reluctance flux path and a second high reluctance flux path when the armature (40) is in a second position. A pair of electromagnetic coils (60, 61) are used to drive the armature (40) between the first and second positions. The geometric design of the actuator is such that by increasing one linear dimension of the device by adding lamination to the yoke and making corresponding increases in the same linear dimension of magnet and armature the permanent magnet flux can be increased to meet any specification of device required using the same basic components. The design of the laminated yoke is adapted to considerably improve the low reluctance path to form a more compact device and provide higher holding forces and faster switching times.

2 Claims, 3 Drawing Sheets

METHOD OF MANUFACTURING A BISTABLE MAGNETIC ACTUATOR

The present invention relates to magnetic actuators, and in particular to actuators suitable for the operation of electric circuit breakers.

In all electric circuit breakers it is necessary to have a mechanism that will open and close contacts in order to interrupt or close an electric circuit.

Conventional high-voltage circuit breakers include mechanical systems for opening and closing the circuit breaker contacts that are very complex to build and require periodic and expensive overhaul and maintenance. The advent of modern vacuum interrupters for use in high voltage circuit breakers, requiring no maintenance or overhaul, has led to the desire to make available actuator mechanisms requiring little or no maintenance and ideally matched to the characteristics of the vacuum interrupter.

These characteristics typically include: short stroke of the moving contact between open and closed positions, usually of the order of 8 to 12 mm; low operating times, typically 10 milliseconds between open and closed positions during operation; high pressure force between contacts when closed to withstand electromagnetic forces during short circuits; and low operating energy.

Prior art bistable permanent magnet actuators meet some of the above characteristics but typically have a number of disadvantageous features.

For example, in UK Patent Application No. 2112212 there is described a relay which has a bistable permanent magnet actuator. This relay includes an electromagnetic coil wound around the armature to provide the necessary electromagnetic driving force to move the actuator between the two bistable positions. This design has a number of disadvantages, not least that the flux generated by the coil works in opposition to the permanent magnet flux, thus having a tendency to destroy the permanent magnets in time. Additionally, considerable flux must be generated to oppose and overcome the permanent magnet flux, and the movement of the actuator is thus rapid and substantially uncontrolled. These types of device are inherently unsuitable for actuators requiring large holding forces, as they will suffer considerable damage when electromagnetic fluxes large enough to overcome the permanent magnet flux are generated. They thus have application only in lower power rôles. In addition, the coil is mounted on the moving part (the actuator) thereby requiring a more complex and less reliable configuration.

In a further example, UK Patent Application No. 2223357 there is described a bistable, magnetically actuated circuit breaker. This device includes a dual yoke construction, each yoke providing either the low reluctance permanent magnet flux path or the high reluctance path of the bistable configuration. The permanent magnet is housed between two halves of the actuator. Actuation is provided by one of two electromagnetic coils which operate to destabilise the armature without substantially reducing the flux in the permanent magnet. A substantial disadvantage of this device is that the magnet is located in the armature, and thus for actuators requiring large holding forces, is prone to physical damage under the impact of switching the armature position. A further substantial disadvantage of this device is that the conduction of permanent magnet flux around the device is inefficient and large magnets are required to achieve reasonable holding force. Similarly, generation of electromagnetic flux is inefficient and large switching currents are required.

Where prior art designs of actuator have been made to accommodate high power circuit breakers requiring large holding forces, it has always been necessary to provide electromagnetic coils capable of generating very large opposing fluxes in order to switch the actuator from one bistable position to the other. While this is not always a problem, it is particularly difficult where the breakers must have an independent source of power in order to switch, such as those which must be powered by integral batteries which are required to have a long, maintenance-free life. In addition, the use of high power coils necessarily increases the size of the actuators, and may necessitate expensive cooling mechanisms where frequent switching occurs.

There is therefore a need to provide a permanent magnet actuator which is simple and cheap to manufacture, suitable for use with high power applications generating large holding forces, with substantially lower power consumption than known systems, and easily configurable to a variety of specifications.

In accordance with one aspect of the present invention, there is provided a bistable permanent magnet actuator comprising:

a magnetic yoke;

at least one permanent magnet; and an armature axially reciprocable in a first direction within the yoke; the actuator configured to provide:

a first low reluctance flux path and a first high reluctance flux path when the armature is in a first position;

a second low reluctance flux path and a second high reluctance flux path when the armature is in a second position;

means to drive the armature between the first and second positions;

characterized in that:

the yoke comprises a laminated structure.

In accordance with a further aspect of the present invention, there is provided a method of manufacturing a bistable permanent magnet actuator comprising the steps of:

constructing a magnetic yoke from a plurality of laminations each configured to form a part of a magnetic circuit with at least one permanent magnet and an armature axially reciprocable in a first direction within the yoke;

configuring the actuator to provide a first low reluctance flux path and a first high reluctance flux path when the armature is in a first position and a second low reluctance flux path and a second high reluctance flux path when the armature is in a second position;

providing means to drive the armature between the first and second positions; and using a predetermined number of laminations to expand the device in a linear direction orthogonal to the plane of the yoke laminations, and increasing the corresponding linear dimension of the magnet(s) and armature in order to increase in the permanent magnet flux flowing through the actuator to achieve the desired specification of actuator.

Embodiments of the present invention will now be described by way of example, and with reference to the accompanying drawings in which.

Figure 1:
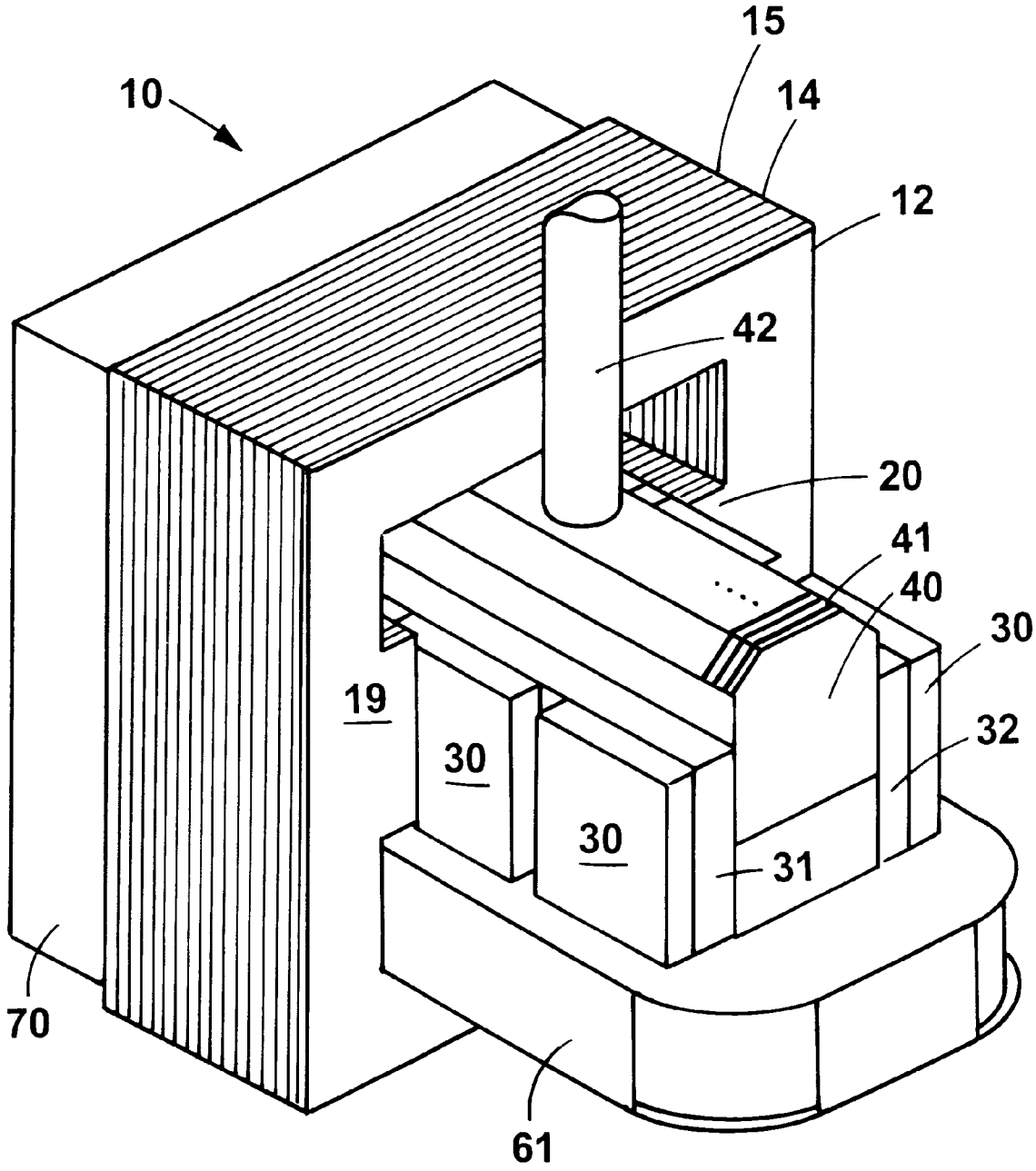
FIG. 1 shows a perspective view of part of a magnetic actuator in accordance with one embodiment of the present invention, with one coil and yoke laminations removed to reveal internal components.

With reference to the figures, a bistable, permanent magnet actuator is shown generally as 10. The actuator comprises an outer yoke 12, which is composed of a number of laminations 14,15 formed of a suitably high magnetic permeability material, for example steel sheets. Each lamination has an upper and a lower pole portion 16,17 and preferably includes a pair of centre arms 19,20 projecting inwards from side portions 22,23. Although the preferred embodiment has been shown as symmetrical about a vertical centre line on FIG. 2, it will be understood that one of the side portions 22,23 could be omitted.

Figure 2:
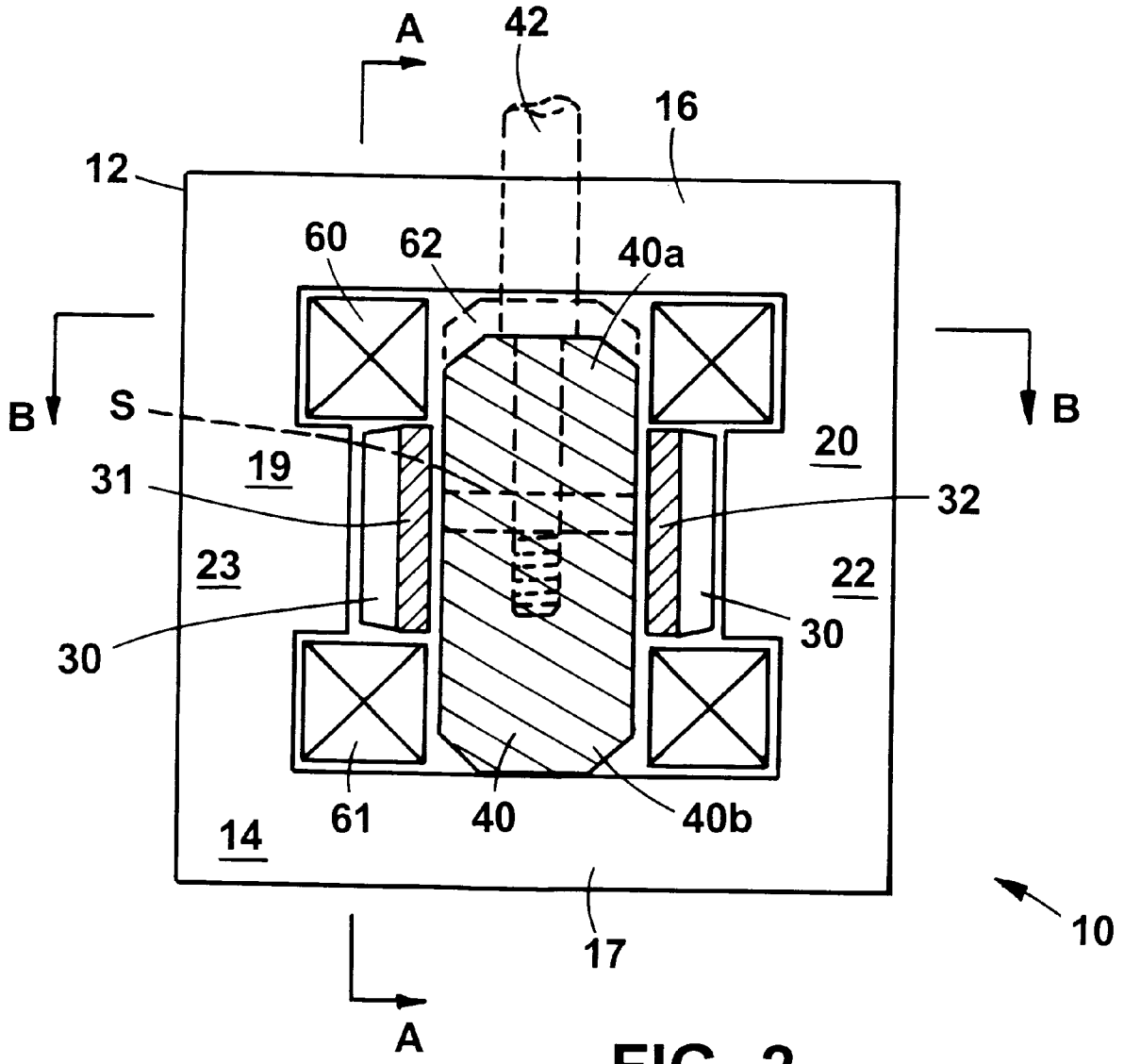
FIG. 2 shows an end view of a centre cross-section of the complete actuator of FIG. 1.
Figure 3:
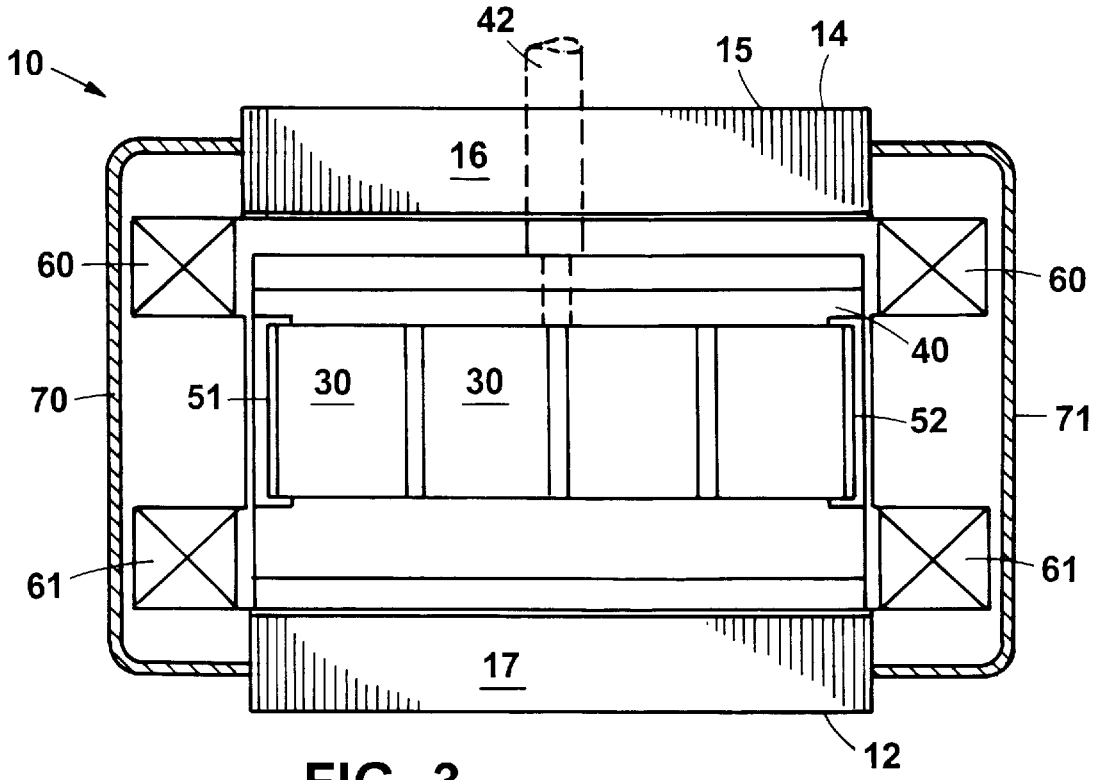
FIG. 3 shows a side view on cross-section A—A of the actuator of FIG. 2, but with the leading part of both coils removed for clarity.
Figure 4:
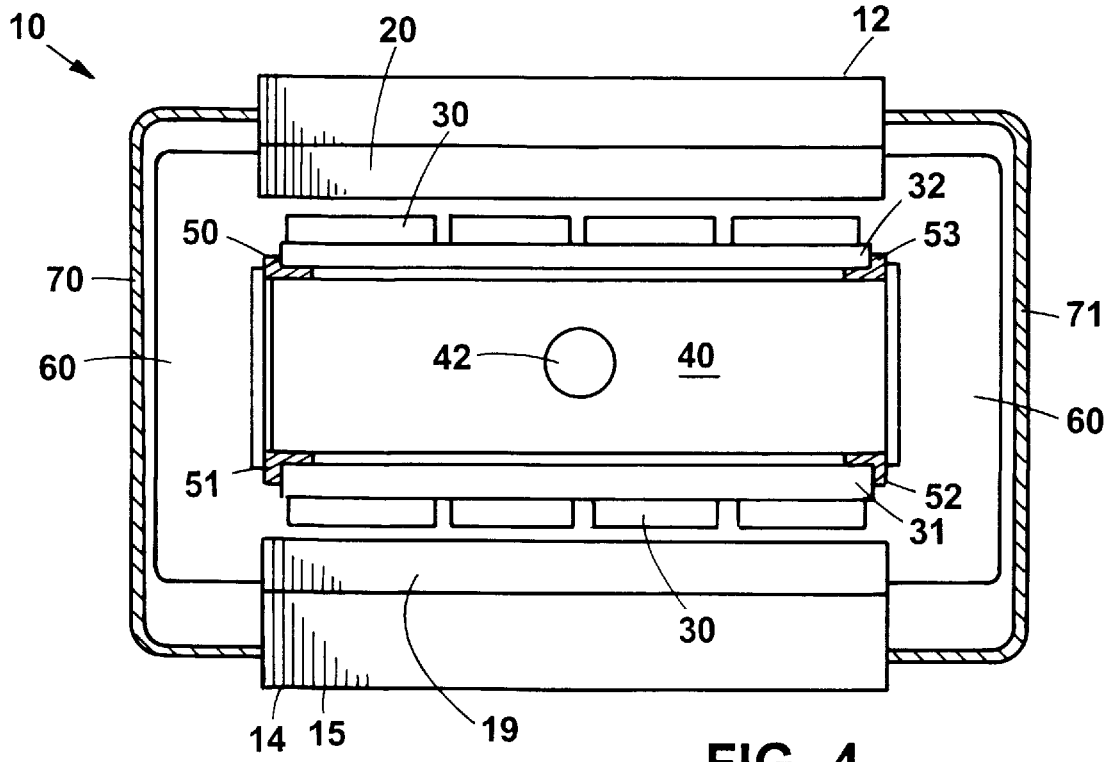
FIG. 4 shows a top view on cross-section B—B of the actuator of FIG. 2, but with the upper coil removed for clarity.

Within the laminations 14,15 of yoke 12, and preferably lying between and adjacent to centre arms 19,20 are a number of permanent magnets 30. Magnets 30 are attached to a pair of inner yokes 31,32 which are spaced from an armature 40 which is reciprocally mounted within the assembly in order that it may slide between a first, lower position in which the lower face of the armature 30 is in contact with the lower pole portion 17 of yoke 12 as shown in FIG. 2, and a second upper position in which the armature is in contact with the upper pole portion 16 of yoke 12. Coaxial with the armature 40 is an actuator rod 42 shown in dotted outline on the figures. Four bearing plates 50 . . . 53 (see FIGS. 3 and 4) are positioned between the ends of inner yokes 31,32 and the armature 40 to facilitate smooth linear movement of the armature within the yokes.

A pair of coils 60,61 circumscribe the upper and lower portions of armature 40 respectively. The coils are preferably mounted within the recesses formed between the poles 16,17 of the yoke 12 and the centre arms 19,20. The whole assembly may then be bolted together and provided with end caps 70,71.

With the armature 40 in the position as shown in the figures, a low reluctance magnetic circuit is formed by the magnet 30, the lower half of side portion 22 of yoke 12, the lower pole 17 of yoke 12, the lower half of armature 40 and the inner yoke 32. A high reluctance magnetic circuit is formed by magnet 30, the upper half of side portion 22 of yoke 12, the upper pole 16 of yoke 12, the upper half of armature 40 and the inner yoke 32. Corresponding circuits are replicated on the left half of the actuator as viewed in FIG. 2.

In this position, a strong permanent magnet flux is present in the low reluctance circuit which holds the armature in the lower position. Little flux is present in the high reluctance circuit due to the air gap 62 present between the upper part of the armature 40 and the upper pole 16 of the yoke 12. However, it will be recognized that the temporary application of a current of appropriate polarity in upper coil 60 will cause a high flux to be forced across the air gap 62, providing an upward motive force on armature 40 in order to close the air gap. Providing the flux induced by coil 60 is greater than the flux present in the low reluctance circuit, the armature will be "flipped" to an upper position; thus swapping over the high and low reluctance circuits described supra.

The armature may be returned to its first bistable position by analogous use of the lower coil 61.

This action offers considerable improvement over some types of actuator in that the coils never serve to oppose the permanent magnet flux, and thus do not tend to destroy the permanent magnets over time.

The use of an outer yoke 12 comprised of a number of laminations has several important advantages. Firstly, the permanent magnet flux flowing through the low reluctance circuits is greatly improved for given magnet strengths: this enables a very substantial increase in the holding force of the actuator for a given magnet strength and for a given size of actuator. Additionally, the transient power consumed by coils 60,61 to switch the armature from one bistable position to the other is substantially reduced as more efficient flux generation in the yoke takes place. Not only does this result in a substantially reduced current consumption during switching, but it is discovered that substantially shorter current pulse times can be used to effect the switching operation.

Improvements in the performance of the device are also found with the use of the "one-piece" outer yoke lamination configuration: that is to say, both the low reluctance path and the high reluctance path of a bistable position are provided in the same structure (ie. in each lamination). This also assists in the transient flux generation by the appropriate coil 60,61.

Traditionally, prior art devices have been constructed around a cylindrical armature with a cylindrical yoke, or separate yokes radially spaced around the outside of the cylindrical armature. A substantial advantage in the particular geometrical configuration of actuator illustrated in the figures is that devices of varying specification can be manufactured using standard parts. By increasing the number of laminations 14,15 used, the number of magnets 30 used, and the length of armature, the device is expandable along the axis perpendicular to the plane of the laminations. This permits any desired size of device to be manufactured, and increasing length provides greater and greater holding force of the finished actuator. Thus, actuators can readily be manufactured to provide just sufficient holding force for any particular application, while avoiding the necessity of using substantially over-specified devices which use more current than strictly necessary for the application. It will be understood that in similar manner to the lamination of the yoke, the armature 40 could also be laminated in similar manner for optimum versatility.

In practice, it is not essential to use an inner yoke 31,32 providing that some means to attach the magnets to the outer yoke is provided.

An additional preferred feature is the provision of the armature in two halves 40*a*, 40*b* as shown in FIG. 2. This considerably eases the assembly of the actuator. When constructing an actuator, very considerable forces must be overcome to place magnets and armature in position to complete the magnetic circuits. It is preferable to assemble the actuator with unmagnetised "permanent magnets". The two armature halves have a "slug" of high permeability material introduced between them and are then slid into position between the respective upper and lower pole portions 16,17 of the outer yoke 12. The slug effectively expands the armature sufficiently so that the air gap 62 is eliminated. The remaining parts of the actuator are assembled, with the exception of actuator rod 42. Magnetisation of the magnets 30 then takes place by energising both coils in such a way that the desired polarity of magnets 30 are created.

The slug is then removed, and the actuator rod 42 is passed through the upper pole portion 16 of the yoke and into a preformed hole in the upper half of the armature. The lower end of the actuator rod 42 is threaded, as is the corresponding preformed hole in the lower half of the armature. The two halves of the armature may thus be brought together by screw threading the actuator rod into the hole in the lower half of the armature. Thus, the necessary mechanical advantage to overcome the magnetic forces is provided by suitable torque on the actuator rod 42.

We claim:

1. A method of manufacturing a bistable permanent magnet actuator comprising the steps of:

constructing a magnetic yoke from a plurality of laminations each configured to form a part of a magnetic circuit with at least one permanent magnet and an armature axially reciprocable in a first direction within the yoke;

forming the armature in two halves by division of the armature by a plane orthogonal to said first direction;

introducing a slug of high permeability material between the two halves of the armature and installing the armature and slug into the yoke;

removing the slug and installing an actuator rod adapted to draw together said two armature halves in a direction parallel to said first direction;

configuring the actuator to provide a first low reluctance flux path and a first high reluctance path when the armature is in a first position and a second low reluctance flux path and a second high reluctance flux path when the armature is in a second position;

providing means to drive the armature between the first and second positions; and using a predetermined number of laminations to expand the device in a linear direction orthogonal to the plane of the yoke laminations, and increasing the corresponding linear dimension of the at least one magnet and armature in order to increase in the permanent magnet flux flowing through the actuator to achieve the desired specification of actuator.

2. A method of manufacturing a bistable permanent magnet actuator according to claim 1, further comprising the steps of:

installing the at least one permanent magnet in an unmagnetised state;

after installation of the armature and slug, and before removal of the slug, magnetizing the at least one permanent magnet in situ.

* * * * *